US010843312B2

(12) United States Patent
van Slooten et al.

(10) Patent No.: US 10,843,312 B2
(45) Date of Patent: Nov. 24, 2020

(54) MAGNETIC WAND FOR WINDOW BLINDS

(71) Applicant: Home Depot Product Authority, LLC, Atlanta, GA (US)

(72) Inventors: Jeff van Slooten, Atlanta, GA (US); Nicholas Jackson, Marietta, GA (US)

(73) Assignee: Home Depot Product Authority, LLC, Atlanta, GA (US)

( * ) Notice: Subject to any disclaimer, the term of this patent is extended or adjusted under 35 U.S.C. 154(b) by 68 days.

(21) Appl. No.: 15/867,371

(22) Filed: Jan. 10, 2018

(65) Prior Publication Data

US 2019/0210195 A1 Jul. 11, 2019

(51) Int. Cl.

| | |
|---|---|
| ***E06B 9/32*** | (2006.01) |
| ***B25B 11/00*** | (2006.01) |
| *B25B 9/02* | (2006.01) |

(52) U.S. Cl.

CPC ..... *B25B 11/002* (2013.01); *E06B 9/32* (2013.01); *B25B 9/02* (2013.01)

(58) Field of Classification Search

CPC .. E06B 2009/3222; E06B 9/326; E06B 9/368; E06B 9/2624; E06B 9/42; E06B 2009/425; E06B 9/322

USPC ..... 16/422, 477

See application file for complete search history.

(56) References Cited

U.S. PATENT DOCUMENTS

| | | | | |
|---|---|---|---|---|
| 6,089,303 | A * | 7/2000 | Metcalf | E06B 9/307 160/176.1 R |
| 7,191,817 | B2 | 3/2007 | Nicolosi | |
| 8,480,147 | B2 * | 7/2013 | Jones | B66F 19/00 16/446 |
| 8,739,853 | B2 | 6/2014 | Judkins | |
| 8,981,681 | B2 * | 3/2015 | Malekpour | E06B 9/36 318/266 |
| 9,885,208 | B1 * | 2/2018 | Chen | E06B 3/285 |
| 2007/0084567 | A1 * | 4/2007 | Chen | E06B 9/32 160/84.05 |
| 2014/0012165 | A1 * | 1/2014 | Cockley | B25G 3/02 601/37 |
| 2018/0106105 | A1 * | 4/2018 | Anthony | E06B 9/72 |

* cited by examiner

*Primary Examiner* — Katherine W Mitchell
*Assistant Examiner* — Jeremy C Ramsey
(74) *Attorney, Agent, or Firm* — Greenberg Traurig, LLP

(57) ABSTRACT

A magnetic wand is used for adjusting window blinds. The blinds include slats and a slat angle adjustment mechanism. The wand includes an upper housing portion and a handle portion. The upper housing portion has a connecting mechanism disposed on one end and a docking area on a second end. The connecting mechanism is adapted to connect the upper housing portion to the window blinds. A first magnetically attractive element is disposed within the docking area. The handle portion has an end shaped to fit within the docking area. The end includes a second magnetically attractive element. The second magnetically attractive element is adapted to releasably couple with the first magnetically attractive element through magnetic coupling, forming a magnetic joint. That magnetic joint is configured to prevent the handle portion from longitudinally rotating independently relative to the upper housing portion.

7 Claims, 6 Drawing Sheets

MAGNETIC WAND FOR WINDOW BLINDS

BACKGROUND

Cords for adjusting the height of window blinds are a well-known safety hazard for children. The Consumer Product Safety Commission has called for the elimination of cords to prevent injuries and accidental deaths. The Window Covering Manufacturers Association, a business association including nearly all manufacturers of corded and cordless blinds, has agreed that all stock products will be cordless or include inaccessible cords by 2019 to prevent unnecessary injury. This will account for an estimated 80 percent of all window covering products sold in the U.S. and Canada.

However, cordless blinds do not work for all people. Corded blinds are commonly used by the elderly, those short in stature or with disabilities, or people with hard-to-reach windows. Cordless blinds are often inaccessible or unusable by these individuals whether due to the height and location of the window or the force needed to lift the blinds.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

A magnetic wand is used for adjusting window blinds. The blinds include slats and a slat angle adjustment mechanism. The wand includes an upper housing portion and a handle portion. The upper housing portion has a connecting mechanism disposed on one end and a docking area on a second end. The connecting mechanism is adapted to connect the upper housing portion to the window blinds. A first magnetically attractive element is disposed within the docking area. The handle portion has an end shaped to fit within the docking area. The end includes a second magnetically attractive element. The second magnetically attractive element is adapted to releasably couple with the first magnetically attractive element through magnetic coupling, forming a magnetic joint. That magnetic joint is configured to prevent the handle portion from longitudinally rotating independently relative to the upper housing portion.

Another example window blind system with a removable magnetic wand includes a plurality of slats suspended and spaced on a plurality of vertically oriented cables. Each of the slats is adjustable in relative vertical position and angular orientation. A mounted headrail supports each of the cables and includes a slat angle adjustment mechanism that translates rotation of a blind attachment point into angular rotation of the slats. A bottom rail is also supported by the at least one of the cables and positioned below the slats. The wand includes an upper housing portion and a handle portion. The upper housing portion has a connecting mechanism disposed on one end that is adapted to connect the upper housing portion to the window blinds and a docking area on a second end. A first magnetically attractive element is disposed within the docking area. The handle portion has an end shaped to fit within the docking area. The end includes a second magnetically attractive element. The second magnetically attractive element is adapted to releasably couple with the first magnetically attractive element through magnetic coupling, forming a magnetic joint. That magnetic joint is configured to prevent the handle portion from longitudinally rotating independently relative to the upper housing portion.

Another example cordless wand retrofitting kit with a removable magnetic wand for a window blind system. The windows blinds system includes a plurality of slats suspended and spaced on a plurality of vertically oriented cables. A bottom rail is supported by at least one cable and positioned below a plurality of slats. The wand includes an upper housing portion and a handle portion. The upper housing portion has a connecting mechanism disposed on one end and a docking area on a second end. The connecting mechanism is adapted to connect the upper housing portion to the window blinds. A first magnetically attractive element is disposed within the docking area. The handle portion has an end shaped to fit within the docking area. The end includes a second magnetically attractive element. The second magnetically attractive element is adapted to releasably couple with the first magnetically attractive element through magnetic coupling, forming a magnetic joint. That magnetic joint is configured to prevent the handle portion from longitudinally rotating independently relative to the upper housing portion. A third magnetically attractive element is affixed to the bottom rail of the window blinds. The end of the handle portion is also adapted to releasably couple with the third magnetically attractive element through magnetic coupling.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, and components have not been described in detail as not to unnecessarily obscure aspects of the present invention.

Generally speaking, various embodiments of the present disclosure provide for a removable wand for use in a window covering such as a window blind, which may or may not be cordless. The removable wand serves multiple functions. For example, it may be used both for adjusting the angular rotation of the slats. It may also be used to raise and lower the blinds. For example, one embodiment of the removable wand allows for a lower handle portion of the wand to be selectively separated from an upper portion of the wand and magnetically attached to a portion of the blinds to adjust their height.

Figure 1:
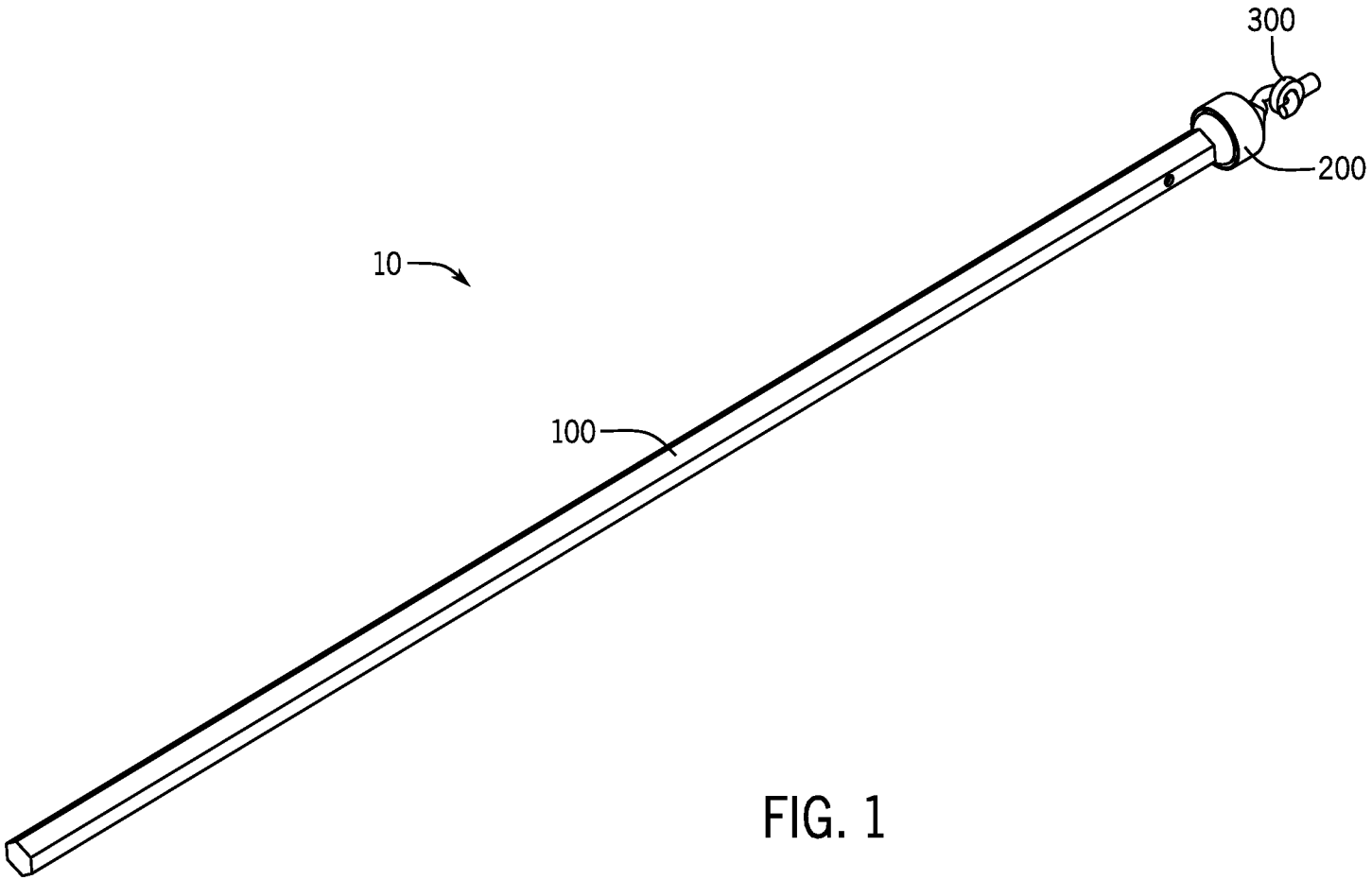
FIG. 1 shows a wand assembly according to various embodiments of the present disclosure.

FIG. 1 shows a wand assembly 10 according to various embodiments of the present disclosure. The wand assembly 10 includes two or more separable components. For example, in the illustrated embodiment, the wand assembly 10 includes a removable handle 100 and upper housing portion 200, which are magnetically linked. The upper housing portion 200 attaches to a conventional window covering via a blind attachment point such as an eyelet 300.

The removable handle 100 is the primary interface used to interact with the removable wand assembly 10. The removable handle 100 is an elongated member that is sized and shaped to be grasped by a user at a comfortable height in order to adjust window blinds in various manners. In some embodiments, the handle 100 is sufficiently long to reach between the hand of a person of below-average height and the top of the window blind. In some examples of the removable wand assembly 10, the handle portion 100 is between 20" and 30" long. In other examples, the handle portion 100 is extensible via telescoping side walls.

The handle portion 100 may be constructed of a plastic material, metal (e.g. aluminum), acrylic or any other suitable material. In the illustrated embodiment, the removable handle portion 100 is a hollow structure with a hexagonal cross-section, such as is common in the window covering industry. A variety of alternative shapes such as simple cylinders or solid extrusions are also contemplated. In other examples, the handle may be made of wood or it may be dyed or otherwise colored to match the aesthetic desires of a user in order to match the replaced conventional wand or to complement a window covering with which the removable wand assembly 10 is integrated.

The upper housing portion 200 is adapted to operably connect the wand assembly 10 to the slat angle adjustment mechanisms of the window covering. In this configuration, the longitudinal rotation of the handle member 100 is transmitted through to the headrail or other structure of the blinds containing the slat angle adjustment mechanism. The upper housing portion 200 is adapted to form a connection to the mechanism in the blinds using an attachment means, such as a latch 202 (shown in FIG. 3) in the example shown. This design takes advantage of the fact that most conventional window coverings use a standard interface such as an eyelet 300. The latch 202 is sized and shaped to fit tightly with this standard opening.

Figure 2:
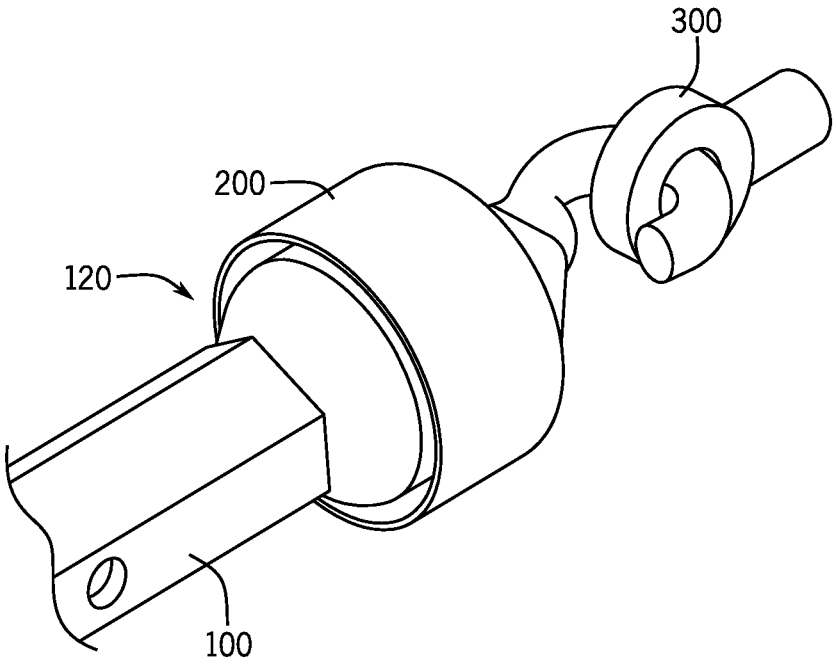
FIG. 2 is an enlarged view of the interface between handle and upper housing portions of a wand assembly, in accordance with various embodiments of the present disclosure.

FIG. 2 is an enlarged view of the interface between handle portion 100 and the upper housing portion 200 as well as a magnetic end 120 of the handle portion 100 in detail, in accordance with various embodiments of the present disclosure. The magnetic end 120 of the handle portion 100, shown in FIG. 2A, enables the handle portion 100 to be selectively attached to and detached from the housing portion 200. In the example shown, magnetic force is exerted by the magnetic end 120, which is attracted to the upper housing portion 200 via a first magnetically attractive element 126 (discussed in detail below with reference to FIG. 4). The magnetic elements could be electromagnetically attractive by ferromagnetic, ferromagnetic, or electromagnetic principles or any other suitable means. In other examples, both the magnetic end 120 and the upper housing portion 200 can be magnetic. Thus, the magnetic end 120 is attached magnetically to the one end of the upper housing portion 200.

On the opposite end of the upper housing portion 200, a hook or latch 202 is positioned in order to connect the wand assembly 10 to the mechanisms within the window blind, such as those which translate rotation of a wand into angular adjustment of the slats. In the example shown, the latch 202 is configured to fit within an eyelet 300 on the blind attachment point. In other examples, the latch 202 and eyelet 300 are reversed, such that the opening is on the upper housing portion 200 and there is a hook on the blind attachment point. Thus, the upper housing portion 200 allows the wand assembly 10 to be installed in existing window coverings as well as be integrated by a manufacturer with new or custom designs.

Figure 3:
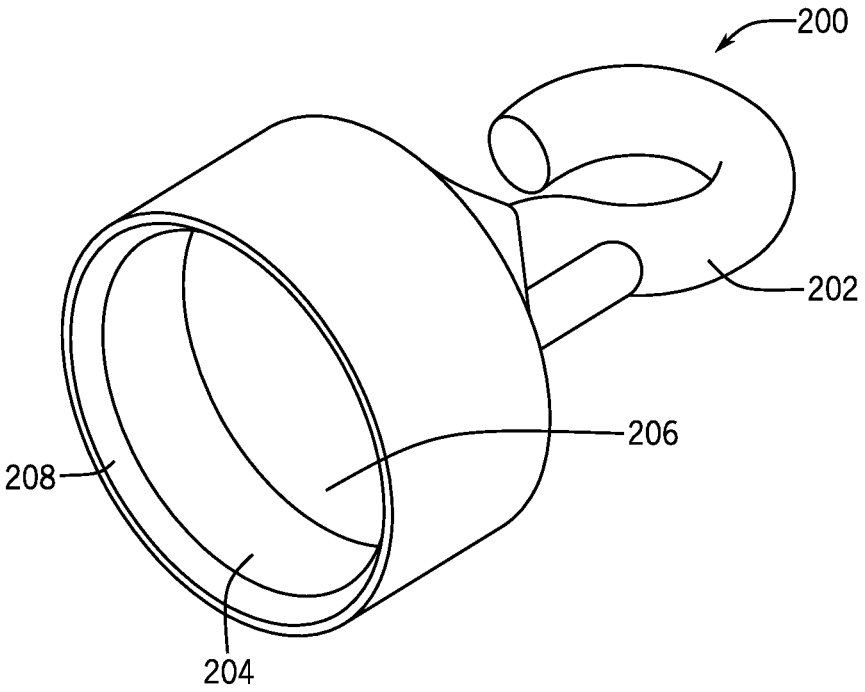
FIG. 3 is an enlarged view of an upper housing portion of a wand assembly, in accordance with various embodiments of the present disclosure.

FIG. 3 is an enlarged view of the upper housing portion 200, in accordance with various embodiments of the present disclosure. As shown, the upper housing portion includes a recessed docking area 204. The recessed docking area 204 is sized to receive the magnetic end 120 of the handle portion 100 and is shaped to complement the perimeter of the magnetic end 120. In the well of the recessed docking area 204, a second magnetically attractive element 206 is positioned to be attracted to and contact the tip of the magnetic end 120. In the example of upper housing portion 200 of the removable wand assembly 10, the recessed docking area 204 is bordered by guidance features, shown as the beveled edges 208, which facilitate the placement of the magnetic end 120 within the recessed docking area 204. The guidance features accomplish the placement by directing the motion of the magnetic end 120 to seat appropriately within the recessed docking area 204. In other examples, the guidance features may be further integrated with the recessed docking area 204 such that the shaping of the whole of the upper housing portion 200 is dedicated to assist the user in forming and securing the magnetic joint.

In the example shown, the perimeter of each of the magnetic end 120 and the recessed area 204 is circular and friction is used to transmit the rotational force between the components. In other embodiments, more complex geometries are used. For example, a hexagonal structure, like that shown in the handle extrusion, could be matched with a complementary hexagonal opening in the recessed area 302 to create mechanically interlocking geometries. The meshed mechanically interlocking geometries transmit the rotation of the parts when the handle portion 100 is rotated.

Figure 4:
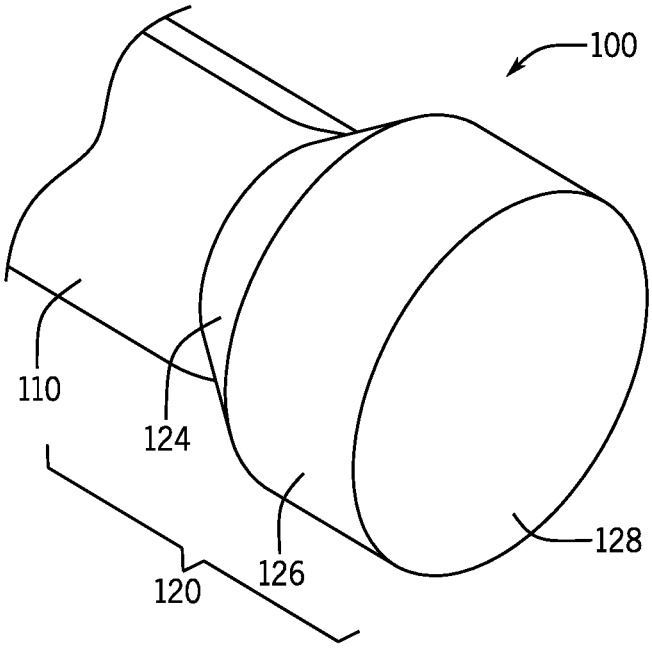
FIG. 4 is an enlarged view of a magnetic end of a handle portion of a wand assembly, in accordance with various embodiments of the present disclosure.

FIG. 4 is an enlarged view of the magnetic end 120, in accordance with various embodiments of the present disclosure. In the illustrated embodiment, the magnetic end 120 is coupled with a handle body 110. The magnetic end 120 includes a mounting extension 124 fitted with a first magnetically attractive element 126. In the illustrated embodiment, the mounting extension 124 is a separate part and affixed to the handle body 110. In other examples, the mounting extension 124 could be integrally formed with the handle body 110. In one such example, the end of a solid handle body 110 may be constructed with an internal cavity or opening sized and shaped to fully and tightly fit to contain the first magnetically attractive element 126. In another example, the first magnetically attractive element 126 is cast or otherwise formed into the handle body 100 during manufacture so as to form an integral unit.

Figure 5:
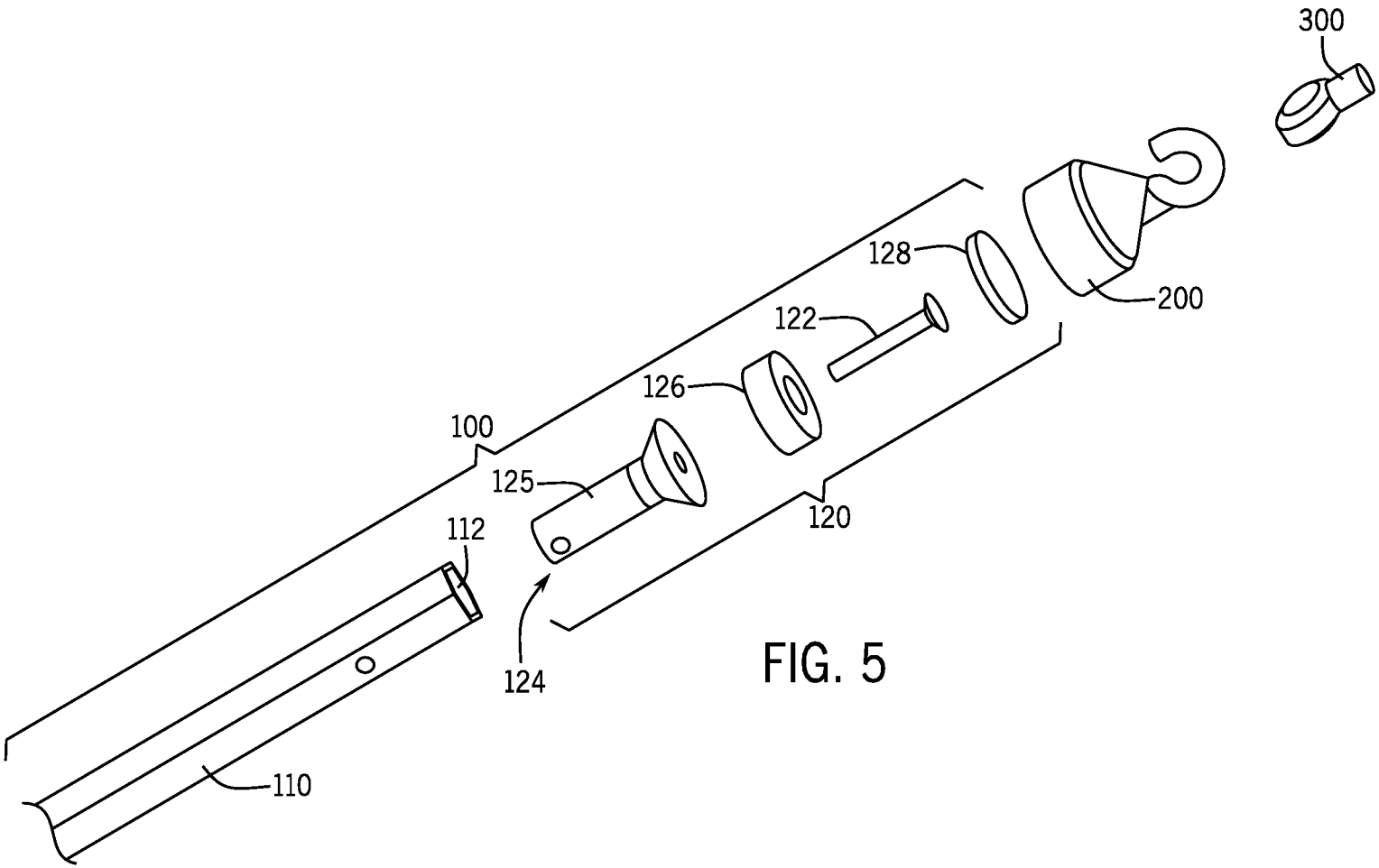
FIG. 5 is an exploded view of a wand assembly, in accordance with various embodiments of the present disclosure.

In the illustrated embodiment, the magnetic end 120 also includes a first magnetically attractive element 126 held on with a fastener 122 (shown in FIG. 5). For increased attractive force, the first magnetically attractive element 126 and first magnetic element must be positioned as near as possible. In some embodiments, the cover 128 may be comprised of a magnetic, ferromagnetic, or other magentizable material such that it can conduct the magnetic force and reduce the effective distance. In the illustrated embodiment, an adhesive is used to connect the cover 128 to the first magnetically attractive element 126. As previously discussed with reference to FIG. 3, the components of the magnetic end 120, including the mounting extension 124 and cover 128 should be matched in size and shape with the complementary portions of the upper housing portion 200.

FIG. 5 is an exploded view of a wand assembly, in accordance with various embodiments of the present disclosure. FIG. 5 shows the mechanism by which the example handle body 110 is connected to the mounting extension 124, in accordance with some embodiments. As shown, a pin 125 on the mounting extension 124 cooperates with a complementary opening 112 the handle body 110. The pin 125 is configured to fit within the opening 112 to prevent relative movement of the components, namely the mounting extension 124 and handle body 110, after installation. For example, the pin 125 and the handle body 110 may be held together by a ball detent. In the illustrated embodiment, the pin 125 is integrally formed with the mounting extension 124. In other embodiments, the pin 125 may be a separate component from then mounting extension 124 and may be inserted through openings in the mounting extension 124 and the handle body 110 and then secured to hold the two components together. Further adhesives or any other suitable connection means may also be used to supplement or replace the fastener 122 or the pin 125.

Figure 6B:
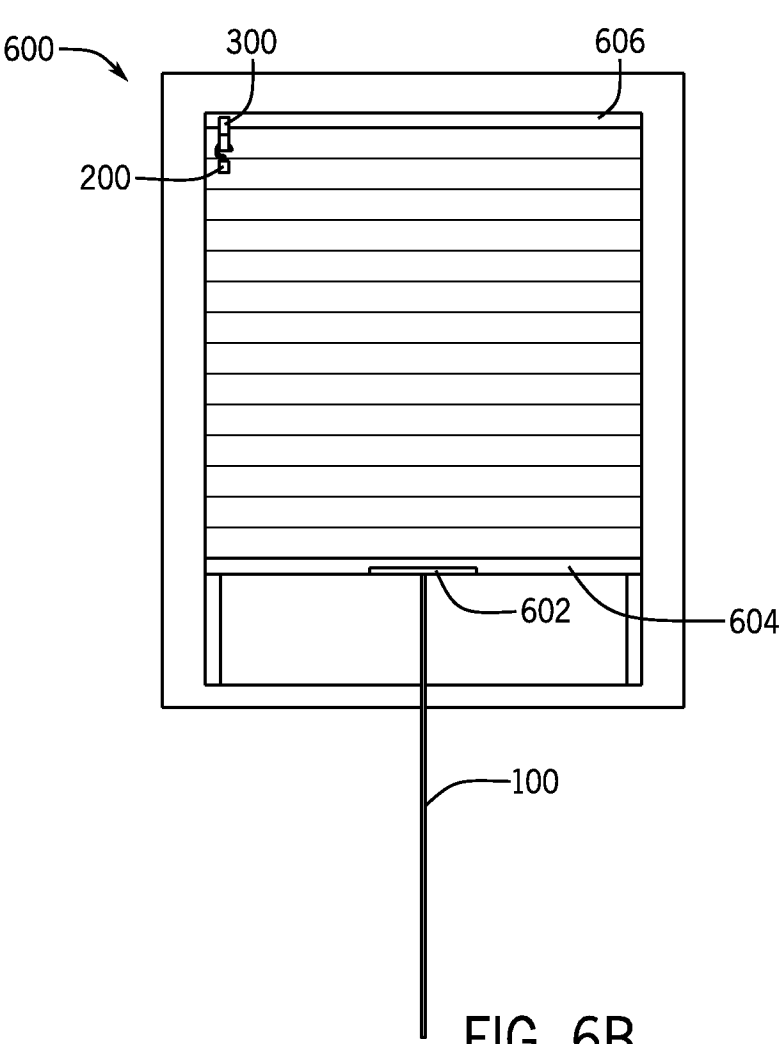
FIG. 6B shows a second configuration of an example wand assembly installed in a conventional cordless blind system, in accordance with various embodiments of the present disclosure.
Figure 6A:
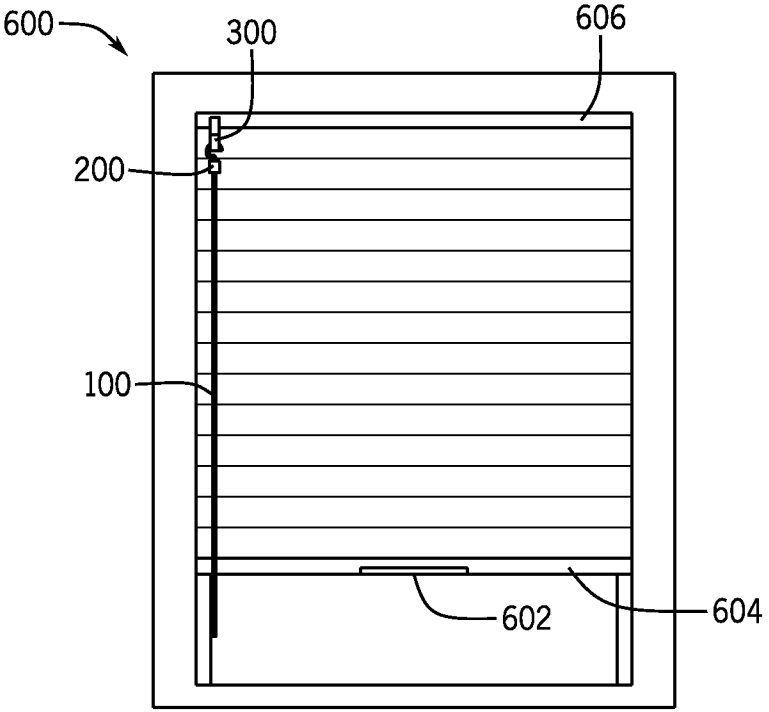
FIG. 6A shows a first configuration of an example wand assembly installed in a conventional cordless blind system, in accordance with various embodiments of the present disclosure.

FIG. 6A shows a first configuration of an example wand assembly 10 installed in a conventional cordless blind system 600, in accordance with various embodiments of the present disclosure. The upper portion 200 of the wand assembly 10 is attached to an eyelet 300 of a headrail 606 of the blind system 600, which in turn is coupled with a slat angle adjustment mechanism. In FIG. 6A, the handle portion 100 is attached to the upper portion 200, e.g., via magnetic attraction. In the first configuration of FIG. 6A, the handle portion 100 may be used (e.g. rotated) to adjust the angular positions of the slats.

The handle portion 100 may also be used to adjust the height of the blinds. To that end, a third magnetically attractive element 602 may be affixed to the bottom rail 604 of the blind system 600. In the illustrated embodiment, the third magnetically attractive element 602 is a ferromagnetic plate attached with an adhesive to the bottom rail 604. In some cordless blind systems, the bottom rail 604 may have a depression or cavity shaped to fit the third magnetically attractive element 602 flush against the surface of the bottom rail 604. In other examples, the blind system 600 may have an integrated plate or other magnetically attractive element 602 preinstalled in the bottom rail 604. The third magnetically attractive element 602 should be sized and shaped to be at least as large the magnetic end 120 to reach the maximum magnetic saturation of the third magnetically attractive element 602.

FIG. 6B shows a second configuration of an example wand assembly 10 installed in a conventional cordless blind system 600, in accordance with various embodiments of the present disclosure. As shown, the handle portion 100 of the wand assembly 10 may be removed from the upper housing portion 200 and affixed to the third magnetically attractive element 602. When the magnetic end 120 of the handle portion 100 is affixed to the third magnetically attractive element 602, it forms a magnetic joint. Using the attached handle portion 100, a user's reach is thereby extended, and the user can fully operate the cordless blind system 600 to adjust the vertical positioning of the bottom rail 604. In some embodiments, the third magnetically attractive element 602 may utilize physical and magnetic friction to prevent the handle from laterally slipping when the user is raising the blinds. In other embodiments, the third magnetically attractive element 602 or bottom rail 604 may be shaped to contain and secure the magnetic end 120 (e.g., with a complementary shaped recess) and prevent this lateral slippage which may be at least frustrating to the user.

The strength of the magnetic attraction may be selected such that the magnetic joint between the magnetic end 120 and the first and third magnetically attractive element 602 is strongly attached but also removable. More specifically, the magnetic force is calibrated such that the handle is not disengaged when pulled generally downward to lower the blinds. To disconnect the magnetic joint, the user may angle off the magnetic end 120 by laterally rotating the handle portion 100 to either side. This uses the mechanical advantage of the lever formed by the handle portion 100 to allow the user to remove the first magnetically attractive element 126 from the second magnetic element 602 with less force than by pulling along the primary axis of the handle portion 100.

In other examples of the handle portion 100 and the upper housing portion 200 may be adapted to connect the wand assembly 10 to other suitable window coverings such as pleated or cellular blinds. The handle portion 100 in this example can be used to raise and lower the blinds via a magnetically attractive element positioned in the cellular blinds. Like the example in FIGS. 6A-6B, the magnetically attractive element is positioned on the bottom portion of the cellular blinds to connect a magnetic joint to the magnetic end 120 of the handle portion 100. An additional magnetic element or series of magnetic elements can use used to position and secure the handle portion 100 when not in use.

Figure 7:
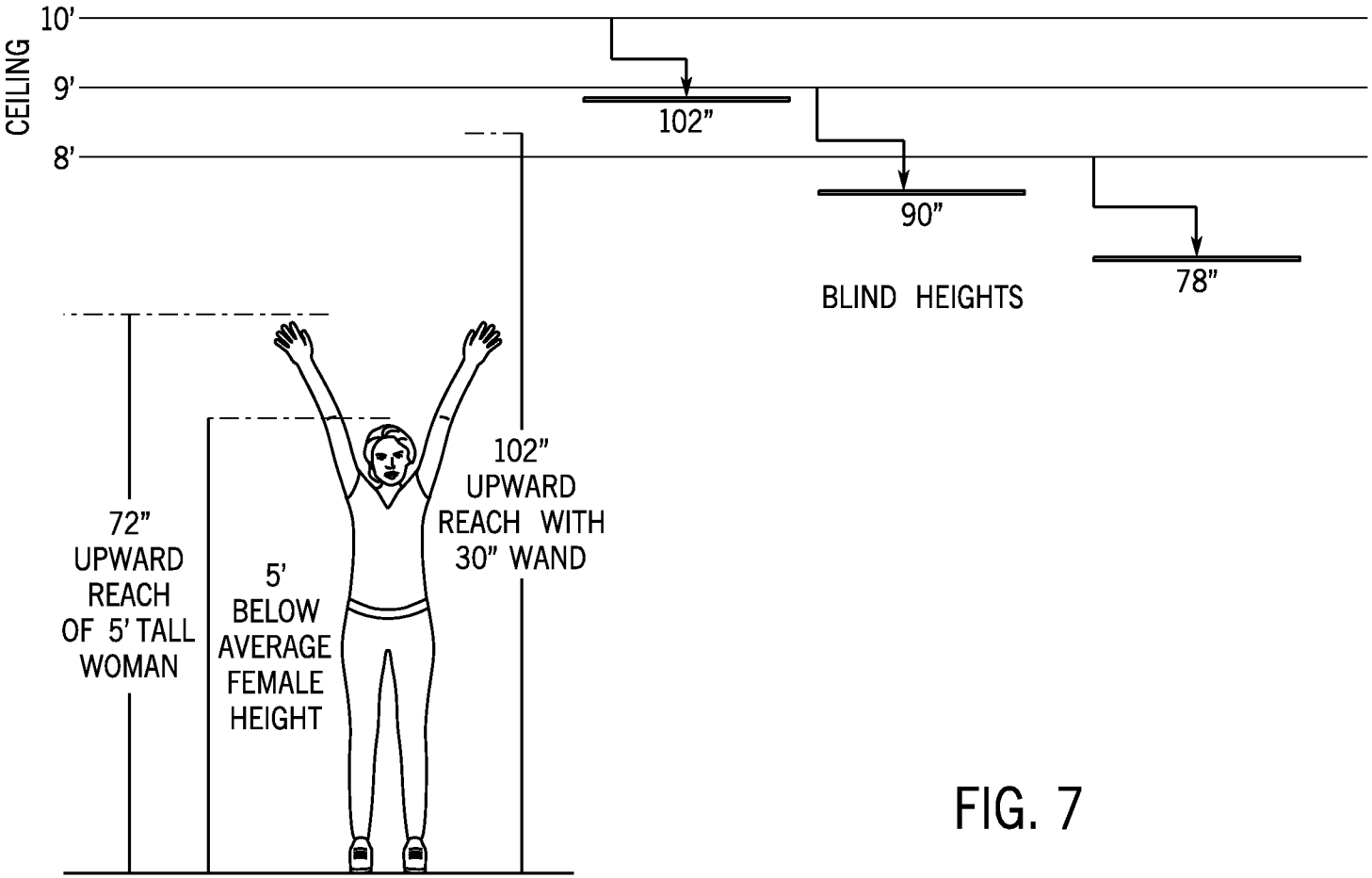
FIG. 7 is a diagram of the reach of an example user with the detachable magnetic wand system, according to various embodiments of the present invention.

FIG. 7 is a diagram comparing the reach of a user with the use of the wand assembly 10. In 2011, the Census Bureau noted that 16% of the women over the age of 70 were 5' tall or less based on survey data gathered in the National Health and Nutrition Examination Survey. Using a 5' tall example user, her average reach would be limited to 72" which would not reach the headrail of a set of 78" blinds, and she therefore could not fully raise them. With a 30" handle portion 100, the same 5 ft user could reach nearly 9' to fully raise a blind system positioned above any of the standard window heights with examples shown at 72", 90", and 100".

Thus, various embodiments of the present disclosure provide for an improved experience in opening and closing blinds. Significantly, the removable wand assemblies according to various embodiments of the present disclosure grant extended reach to the user. Users of short stature are therefore able to more fully utilize their window coverings, which conventional means have left unsatisfied.

The previous description of the disclosed embodiments is provided to enable any person skilled in the art to make or use the present invention. Additionally, terms such as "upper" and "lower" have been used to convey relative positioning of the various components and should not be understood to imply any sort of absolute orientation of the device discussed herein. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A window blind system comprising:

a plurality of slats suspended and spaced on a plurality of vertically oriented cables, wherein the slats are adjustable in a vertical position and an angular orientation;

a headrail supporting each of the plurality of cables, the headrail including a slat angle adjustment mechanism configured to adjust the angular orientation of the plurality of slats responsive to rotation of a blind attachment point thereof;

a bottom rail supported by the at least one of the plurality of cables and positioned below the plurality of slats;

a magnetic wand comprising:

an upper housing portion including:

a connecting mechanism disposed on a first end of the upper housing portion and adapted to connect the upper housing portion to the window blinds, the connecting mechanism operably connected to the blind attachment point;

a docking area on a second end of the upper housing portion; and a first magnetically attractive element disposed within in the docking area; and a handle portion having an end comprising a second magnetically attractive element, the end being sized and shaped to fit within the docking area of the upper housing portion, wherein:

the second magnetically attractive element is adapted to releasably couple with the first magnetically attractive element through magnetic coupling to form a magnetic joint such that the handle portion is removable from the upper housing portion, the magnetic joint is configured to prevent the handle portion from longitudinally rotating independently relative to the upper housing portion; and the docking area and the end of the handle portion are sized and shaped in a complementary manner to transfer longitudinal rotation of the handle portion to the upper housing portion.

2. The cordless blind system of claim 1 wherein when the handle portion is adapted to magnetically attach to a third magnetically attractive element centrally located on the bottom rail and used to raise and lower the cordless blinds.

3. The cordless blind system of claim 1, wherein a magnetic force of the magnetic end is calibrated such that a user can pull the blinds using a magnetic connection to the bottom rail but still remove the handle portion from upper housing portion.

4. The cordless blind system of claim 1, wherein the docking area is recessed.

5. The cordless blind system of claim 2, wherein at least one of the first magnetically attractive element and the second magnetically attractive element comprises a magnet.

6. The magnetic wand of claim 5, wherein at least one of the first magnetically attractive element, the second magnetically attractive element, or the third magnetically attractive element comprises a magnet.

7. The cordless blind system of claim 1, wherein the magnetic joint is mechanically interlocking.

* * * * *